United States Patent [19]

Kvamsdal

[11] 4,202,648

[45] May 13, 1980

[54] FLOATING PLANT FOR OFFSHORE LIQUEFACTION, TEMPORARY STORAGE AND LOADING OF LNG

[75] Inventor: Rolf Kvamsdal, Moss, Norway

[73] Assignee: Moss Rosenberg Verft A/S, Moss, Norway

[21] Appl. No.: 937,094

[22] Filed: Aug. 28, 1978

[30] Foreign Application Priority Data

Sep. 6, 1977 [NO] Norway ..... 773076

[51] Int. Cl.[2] ..... B63B 35/44

[52] U.S. Cl. ..... 405/210; 114/256; 405/195

[58] Field of Search ..... 405/210, 53, 207, 200, 405/203, 205; 114/264, 265, 256, 74 A

[56] References Cited

U.S. PATENT DOCUMENTS

| | | | |
|---|---|---|---|
| 3,572,278 | 3/1971 | Knapp et al. | 405/210 |
| 3,680,323 | 8/1972 | Bognaes | 114/74 A |
| 3,870,003 | 3/1975 | Mo | 405/210 |

*Primary Examiner*—Dennis L. Taylor

*Attorney, Agent, or Firm*—Harold L. Stults; Pasquale A. Razzano

[57] ABSTRACT

A floating plant for offshore liquefaction, temporary storage and loading of LNG, made as a semi-submersible platform with storage tanks for LNG arranged in the submerged section of the platform. The storage tanks are independent spherical tanks which are supported inside the submerged section of the platform and completely surrounded thereby.

6 Claims, 7 Drawing Figures

FLOATING PLANT FOR OFFSHORE LIQUEFACTION, TEMPORARY STORAGE AND LOADING OF LNG

Figure 1:
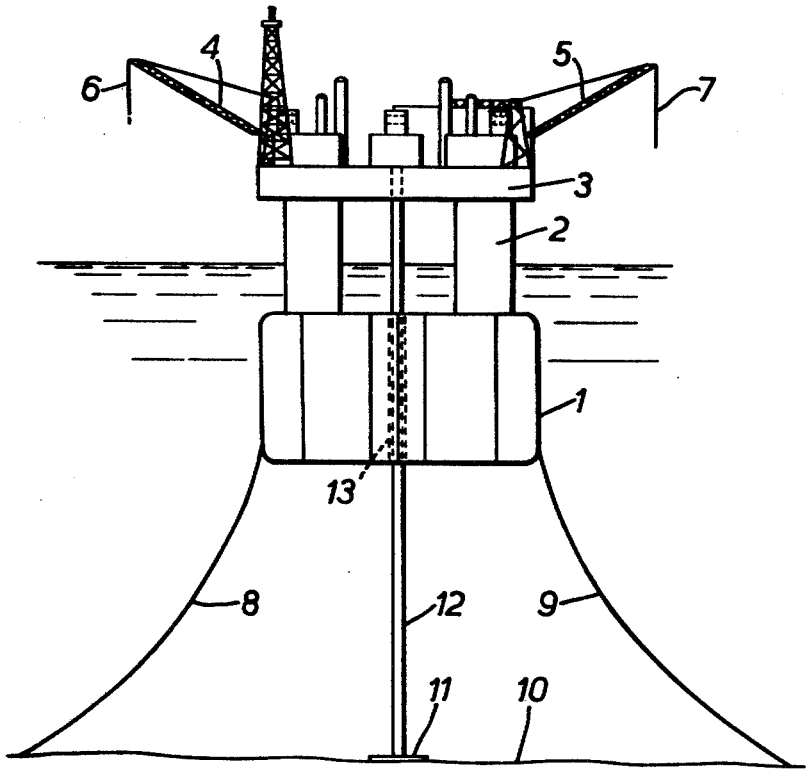

The invention pertains to a floating plant for offshore liquefaction, temporary storage and loading of LNG. The utilization of gas from production fields, e.g., in the North Sea, is dependent on finding methods of transporting the gas from the production site to the consumer in a way that does not increase the price of the gas beyond its market value. An obvious method of transportation is the use of pipelines, but physical restrictions such as the Norwegian trench, insufficient amounts of gas, etc., limit the extent to which pipeline systems can be utilized profitable. Attention has therefore been directed away from pipelines and toward alternative transport systems which can also be used for smaller gas sources and for several gas sources having short production periods Liquefaction of the gas and transport of the gas in the liquid state by ship has proved to be a good alternative and supplement to the transportation of gas in pipelines. This type of system, which will be referred to hereafter as an LNG system, has several advantages. Firstly, the market for this type of system is very wide, relatively speaking. The increasing number of LNG facilities leads one to predict future increases in "spot-sales", sales to facilities having extra capacity, the expansion of existing plants, and the construction of facilities for specific purposes. An LNG system provides great flexibility, since one can operate on a wide market and obtain good prices. Because the gas is in liquid form, peak periods in production output and consumer demand can easily be dealt with, as this will merely be a question of extra storage capacity.

Large floating plants for liquefaction, temporary storage and loading of LNG are planned in Iran. The facilities planned for this region are to be placed on very large barges which have sufficient room for the processing plant and storage tanks. The storage tanks in these planned facilities are of the self-supporting type, patterned after the spherical tank structure which is known as the Moss-Rosenberg spherical tank system. Such structures are based on the "leak before failure" concept—i.e., owing to the inherent strength of the spherical configuration, a crack will propagate so slowly that the time elapsing between the discovery of a leak and the formation of a crack of critical length is sufficient to allow one to reach port, if the spherical tanks are installed on board a ship, and unload the cargo. Similarly, on a storage facility at sea, there would be sufficient time to pump the cargo into other tanks or over to an LNG ship. As stationary, floating facilities, these known spherical tank structures are also very well suited.

The spherical tanks, which do not have stiffening supports, are made either of 9% nickel-steel or of aluminum. The spheres are supported by a cylindrical structure, called the skirt, which rests on the double bottom of the vessel. The upper portion of the skirt is made of aluminum when the tank is also of aluminum. The tank is connected to the skirt by means of a special transition member arranged at the equator of the sphere. The spheres are insulated externally, and the upper portion of the skirt is also insulated.

A decided advantage of the spherical tank system is that the so-called secondary barrier is rendered unnecessary, since the stresses affecting a spherical tank can be calculated in a fully satisfactory manner.

The giant barge construction which is planned for use in Iran would not be suitable for use in waters where the weather is often rough, for example, in the North Sea. The shut-down periods for the processing plant would be too numerous, owing to the fact that a barge of this type would move around too much under the weather conditions prevailing in the North Sea.

Owing to these considerations, then, one has with the present invention chosen to take a different direction in the development of a floating plant for offshore liquefaction, temporary storage and loading of LNG, adapted for areas with rough weather, especially the North Sea. According to the invention, therefore, it is proposed to place the processing plant on a semi-submersible platform and to place spherical storage tanks in the submerged section of the platform.

This arrangement provides several advantages. One obtains an almost perfect separation between the processing module and the storage module, such that safety is significantly improved. The required quarters for personnel can be placed on the processing deck and may optionally be protected by a fire wall, or they can be placed below the processing deck, possibly in one or more of the legs of the platform. A semi-submersible platform is eminently suited for use in rough weather regions, such as the North Sea. Another advantage of the invention is that known and proven components are used in the construction of the platform itself, and especially with respect to the large storage tanks that are required.

The submerged section of the platform, which is to contain relatively large storage tanks for LNG, will have great buoyancy. Ballast is provided to compensate for this. For example, pig iron cast in concrete can be used, but other solutions can also be imagined, e.g. a large and heavy bottom slab of concrete. The platform can be built substantially of steel, substantially of concrete, or as a combined steel-concrete structure.

The semi-submersible platform is anchored in a conventional manner, and the necessary riser pipe(s) preferably pass through a vertical opening in the center of the submerged section of the platform. This will provide good protection for the riser pipe.

According to the invention, therefore, a floating plant for offshore liquefaction, temporary storage and loading of LNG is provided in the form of a semi-submersible platform, and the plant is characterized in that the storage tanks for the LNG are made as spherical tanks that are supported in the submerged section of the platform and completely surrounded thereby.

Preferably, the individual spherical tanks are supported in a manner known per se by respective vertical skirts which extend from the respective horizontal equatorial planes of the spherical tanks and down to a foundation.

In a preferred embodiment of the invention, the spherical tanks are completely surrounded by a sealed, concrete chamber. In another embodiment, the spherical tanks are surrounded by a steel chamber. One could also use a combined steel-concrete enclosure.

Preferably, the completely submerged section of the platform comprises solid ballast in the form of pig iron or the like, cast in concrete. The solid ballast can also comprise a concrete slab which forms the bottom of the completely submerged section.

The completely submerged section of the platform is preferably provided with a central opening for the passage of one or more riser pipes.

The invention will be further elucidated with reference to the drawings, where

Figure 2:
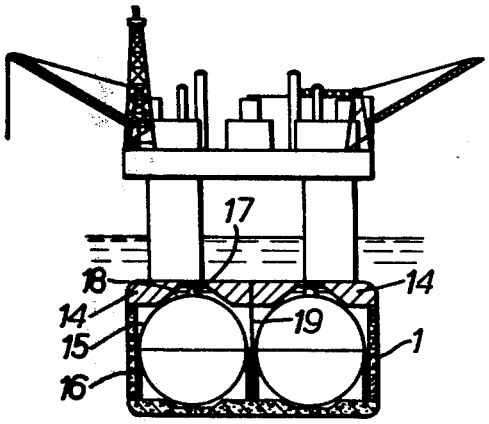
Figure 3:
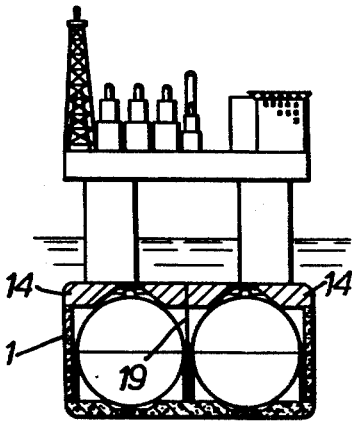
Figure 4:
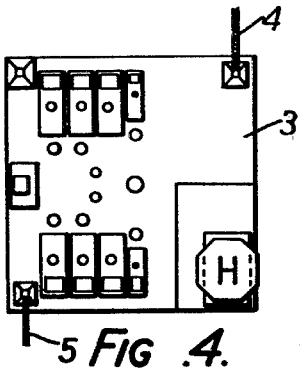
Figure 5:
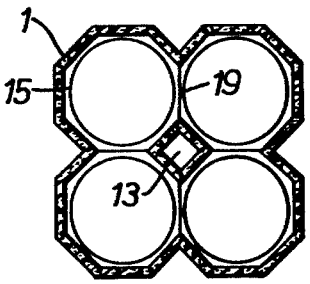
Figure 6:
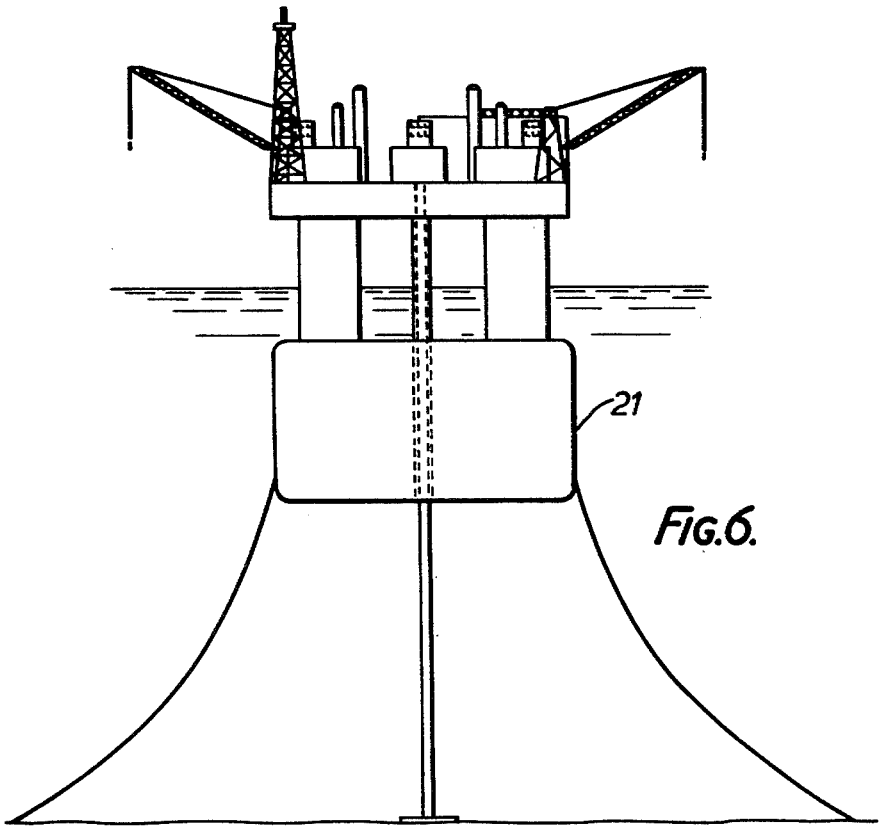
Figure 7:
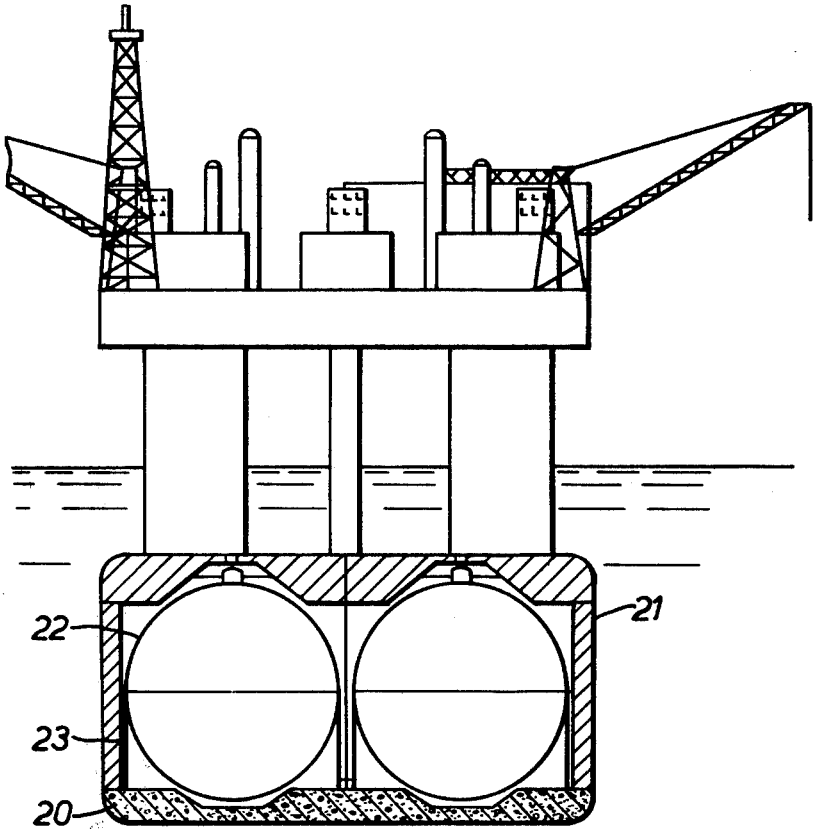

FIG. 1 is a schematic drawing of a floating plant according to the invention,

FIGS. 2 and 3 show respective vertical sections through the submerged section of the platform, FIG. 4 is a plan view of the deck of the platform, FIG. 5 is a horizontal section through the submerged section of the platform, FIG. 6 is a schematic drawing of a second embodiment of the floating plant according to the invention, and FIG. 7 is a vertical section through the submerged section of the platform shown on FIG. 6.

FIGS. 1–5 illustrate one embodiment of a semi-submersible platform, in which at least the completely submerged section 1 is made as a concrete box. The legs 2 and deck 3 can either be concrete structures or steel structures. The necessary processing plant for cooling the gas down to the liquid state and the equipment for loading the gas onto a tanker are placed on the deck 3. The facility for liquefaction of the gas and for the loading of liquefied gas does not constitute a part of the invention per se, and will not be explained in more detail here. In principle, the processing plant could be of the same type as that suggested previously for the giant barge to be built in Iran, i.e., a liquefaction cycle utilizing mixed cooling medium and propane pre-cooling. As indicated on FIG. 1, loading is accomplished via cargo booms 4, 5 from which the required cryogenic hoses 6, 7 extend. Two or more such cargo stations can be provided; the tanker, preferably a spherical tank ship, will moor on the leeward side. It is presumed that weather conditions in most cases will remain relatively constant during the 12- to 16-hour loading period, so that it will not be necessary to shift the mooring.

The platform is anchored in a conventional manner by means of cables 8, 9 which extend down to the sea floor 10. From the sea bed, and more specifically from a well head 11 placed on the sea floor, a riser pipe 12 extends. The riser pipe passes through a vertical opening 13 in the submerged section 1, see FIGS. 1 and 5.

The submerged section 1, in the embodiment shown on FIG. 1, is made as a concrete box. Ballast chambers 14 for water ballast are indicated on FIGS. 2 and 3. From a purely structural point of view, other solutions could of course be chosen. Thus, water ballast chambers could also be arranged in the vertical walls.

In the embodiment shown, the concrete box 1 contains four spherical tanks 15 which rest on the bottom of the concrete box, each tank being supported by means of a vertical skirt 16. The vertical skirts are welded to the respective spherical tanks at the horizontal equatorial plane of the spherical tank and extend down to the foundation, which in this case is formed by the bottom of the concrete chamber. For the domes 17 positioned at the top of the spherical tanks, special chambers 18 are provided in the concrete enclosure. These chambers are well ventilated, and all of the connections to the tanks are arranged therein. The individual spherical tanks are placed in separate compartments which are formed by means of partitions 19.

The embodiment of FIGS. 6 and 7 is similar in principle, but the embodiment in this case is based on a steel structure in the form of a double-walled chamber of steel 24 having a bottom slab 20 of concrete, optionally, loaded with pig iron. The double walls provide good protection against external forces. The completely submerged section 21 is in this case formed as a cylindrical body, as opposed to the completely submerged section 1 in the first embodiment, in which the external configuration of the completely submerged platform section was adapted to a certain degree to conform to the shape of the spherical tanks inside the chamber. The spherical tanks 22 are supported by means of vertical skirts 23 in the second embodiment, and in other respects, too, this embodiment is like the first embodiment. Previously known structures can be used in the construction of the legs and deck, and it is thus not considered necessary to go into further detail about the actual construction of the platform in this specification. A central opening (not shown) for the riser pipe is provided, as in the first embodiment.

This plant has been developed in connection with the need for marketing LNG by means of tankers from production fields in the North Sea, but the invention is naturally not restricted to this area of use. Neither should the invention be construed as being limited entirely to LNG, as the plant could also be used for LPG, for example.

Having described my invention, I claim:

1. In a floating plant for off-shore storage and loading of LNG, the combination of, a submerged module positioned below the surface of the water, an exposed module positioned directly above said submerged module and above the surface of the water, rigid column means interconnecting said modules and supporting said exposed module upon said submerged module, LNG handling facilities mounted upon said exposed module, said submerged module having a plurality of compartments, a plurality of spherical storage tanks for LNG which correspond in number with the number of said compartments and are positioned respectively in said compartments, vertical skirt means comprising a cylindrical skirt substantially surrounding the lower hemisphere of each of said tanks with each of said tanks being supported thereby at substantially its horizontal equator, and means anchoring said submerged module to the sea floor whereby said submerged module is held in stable condition, and said submerged module has sufficient buoyancy to support the entire structure of said exposed module and said column means, with said exposed module being supported thereby above the zone of the surface of the water, and said column means extending throughout a predetermined zone above and below the surface of the water.

2. The construction as described in claim 1, wherein said submerged module includes a shell structure of concrete which is weighted by ballast.

3. The construction as described in either of claims 1 or 2, wherein said column means comprises a plurality of cylindrical columns, each of which is rigidly attached to both of said modules and which provide the sole connection with said submerged module.

4. The construction as described in claim 1 which includes a riser pipe extending from the sea floor to said exposed module.

5. The construction as described in either of claims 2 or 4 which includes a gas processing and liquifying plant mounted upon said exposed module for liquefying gas for delivery to said cylindrical storage containers.

6. In a floating plant for off-shore storage and loading of LNG, the combination of, a buoyant submerged module positioned below the surface of the water, an exposed module positioned directly above said submerged module above the surface of the water, rigid column means extending vertically between and connected rigidly to both of said modules and supporting said exposed module upon said submerged module, LNG handling facilities mounted upon said exposed module, said submerged module having a plurality of compartments, a plurality of spherical storage tanks for LNG which correspond in number with the number of said compartments and are positioned respectively in said compartments, and anchoring means for said submerged module extending from the sea floor whereby said submerged module is held in stable condition by its buoyancy with said buoyancy being sufficient to support the entire floating plant with said column means projecting above the surface of the water and supporting said exposed module and said column means extending throughout a predetermined zone above and below the surface of the water.

* * * * *

UNITED STATES PATENT AND TRADEMARK OFFICE

CERTIFICATE OF CORRECTION

PATENT NO. : 4,202,648

DATED : May 13, 1980

INVENTOR(S) : Rolf Kvamsdal

It is certified that error appears in the above–identified patent and that said Letters Patent are hereby corrected as shown below:

In claim 1, column 4, line 48, "solely" has been inserted after --supported--.

Signed and Sealed this

*Fifteenth* Day of *July 1980*

[SEAL]

*Attest:*

SIDNEY A. DIAMOND

*Attesting Officer*

*Commissioner of Patents and Trademarks*